US006000571A

United States Patent [19]

Brooks et al.

[11] Patent Number: 6,000,571

[45] Date of Patent: Dec. 14, 1999

[54] TRASH RECEPTACLE

[76] Inventors: Michael A. Brooks; Mark Childers, both of 7511 Cane Run Rd. #17, Louisville, Ky. 40258

[21] Appl. No.: 09/073,791

[22] Filed: May 6, 1998

[51] Int. Cl.[6] ..... B65D 8/06; B65D 8/08

[52] U.S. Cl. ..... 220/495.04; 220/908.1; 220/908.2

[58] Field of Search ..... 220/908, 908.2, 220/23.87, 23.88, 87.1, 495.01, 495.05, 495.04

[56] References Cited

U.S. PATENT DOCUMENTS 1,163,389 12/1915 Brown ..... 220/23.87 X
4,294,379 10/1981 Bard ..... 220/908 X
4,765,579 8/1988 Robbins, III et al. ..... 220/908 X

FOREIGN PATENT DOCUMENTS

90/05098 5/1990 WIPO ..... 220/908

*Primary Examiner*—Allan N. Shoap
*Assistant Examiner*—Joe Merek

[57] ABSTRACT

A new trash receptacle for permitting easy removal therefrom of a filled trash bag. The inventive device includes outer and inner portions each having a base and a side wall. The inner and outer portions are spaced apart to define an air space therebetween. The inner base of the inner portion has a plurality of apertures therethrough into the air space between the inner and outer bases to permit air flow from the air space into the interior space of the trash receptacle to help relieve the vacuum formed when a trash bag is removed from the interior space.

9 Claims, 2 Drawing Sheets

TRASH RECEPTACLE

BACKGROUND OF THE INVENTION

1. Field of the Invention

The present invention relates to trash receptacles and more particularly pertains to a new trash receptacle for permitting easy removal therefrom of a filled trash bag.

2. Description of the Prior Art

The use of trash receptacles is known in the prior art. More specifically, trash receptacles heretofore devised and utilized are known to consist basically of familiar, expected and obvious structural configurations, notwithstanding the myriad of designs encompassed by the crowded prior art which have been developed for the fulfillment of countless objectives and requirements.

Known prior art trash receptacles include U.S. Pat. No. 5,492,241; U.S. Pat. No. 5,388,717; U.S. Pat. No. Des. 355,742; U.S. Pat. No. 5,265,755; U.S. Pat. No. 2,060,468; and U.S. Pat. No. 4,294,379.

While these devices fulfill their respective, particular objectives and requirements, the aforementioned patents do not disclose a new trash receptacle. The inventive device includes outer and inner portions each having a base and a side wall. The inner and outer portions are spaced apart to define an air space therebetween. The inner base of the inner portion has a plurality of apertures therethrough into the air space between the inner and outer bases to permit air flow from the air space into the interior space of the trash receptacle to help relieve the vacuum formed when a trash bag is removed from the interior space.

In these respects, the trash receptacle according to the present invention substantially departs from the conventional concepts and designs of the prior art, and in so doing provides an apparatus primarily developed for the purpose of permitting easy removal therefrom of a filled trash bag.

SUMMARY OF THE INVENTION

In view of the foregoing disadvantages inherent in the known types of trash receptacles now present in the prior art, the present invention provides a new trash receptacle construction wherein the same can be utilized for permitting easy removal therefrom of a filled trash bag.

The general purpose of the present invention, which will be described subsequently in greater detail, is to provide a new trash receptacle apparatus and method which has many of the advantages of the trash receptacles mentioned heretofore and many novel features that result in a new trash receptacle which is not anticipated, rendered obvious, suggested, or even implied by any of the prior art trash receptacles, either alone or in any combination thereof.

To attain this, the present invention generally comprises outer and inner portions each having a base and a side wall. The inner and outer portions are spaced apart to define an air space therebetween. The inner base of the inner portion has a plurality of apertures therethrough into the air space between the inner and outer bases to permit air flow from the air space into the interior space of the trash receptacle to help relieve the vacuum formed when a trash bag is removed from the interior space.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new trash receptacle apparatus and method which has many of the advantages of the trash receptacles mentioned heretofore and many novel features that result in a new trash receptacle which is not anticipated, rendered obvious, suggested, or even implied by any of the prior art trash receptacles, either alone or in any combination thereof.

It is another object of the present invention to provide a new trash receptacle which may be easily and efficiently manufactured and marketed.

It is a further object of the present invention to provide a new trash receptacle which is of a durable and reliable construction.

An even further object of the present invention is to provide a new trash receptacle which is susceptible of a low cost of manufacture with regard to both materials and labor, and which accordingly is then susceptible of low prices of sale to the consuming public, thereby making such trash receptacle economically available to the buying public.

Still yet another object of the present invention is to provide a new trash receptacle which provides in the apparatuses and methods of the prior art some of the advantages thereof, while simultaneously overcoming some of the disadvantages normally associated therewith.

Still another object of the present invention is to provide a new trash receptacle for permitting easy removal therefrom of a filled trash bag.

Yet another object of the present invention is to provide a new trash receptacle which includes outer and inner portions each having a base and a side wall. The inner and outer portions are spaced apart to define an air space therebetween. The inner base of the inner portion has a plurality of apertures therethrough into the air space between the inner and outer bases to permit air flow from the air space into the interior space of the trash receptacle to help relieve the vacuum formed when a trash bag is removed from the interior space.

Still yet another object of the present invention is to provide a new trash receptacle that relieves the vacuum that forms between the bottom of a filled trash bag and the bottom of the trash receptacle that makes it difficult to pull the filled trash bag out of the trash receptacle.

Even still another object of the present invention is to provide a new trash receptacle that includes an air fresher that distributes a scent to the interior of the trash receptacle when a filled trash bag is removed from the trash receptacle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
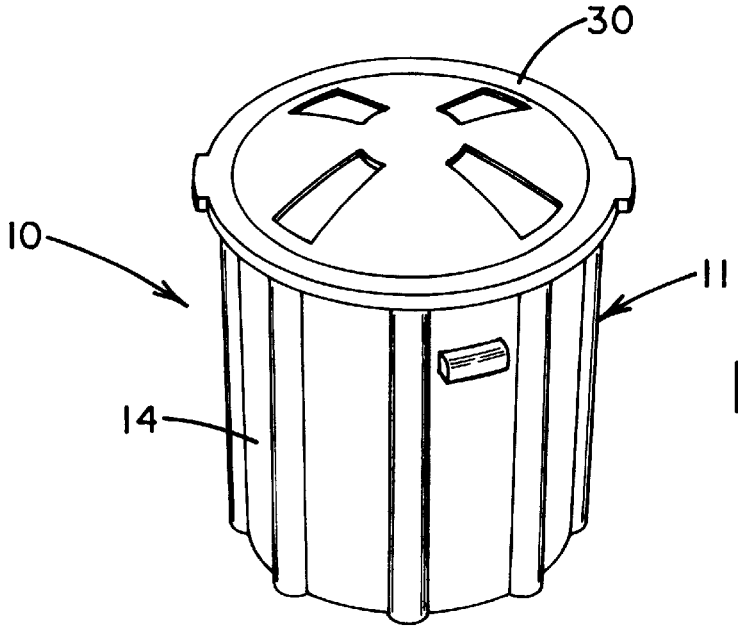
FIG. 1 is a schematic top perspective view of a new trash receptacle according to the present invention.

With reference now to the drawings, and in particular to FIGS. 1 through 4 thereof, a new trash receptacle embodying the principles and concepts of the present invention and generally designated by the reference numeral 10 will be described.

As best illustrated in FIGS. 1 through 4, the trash receptacle 10 generally comprises outer and inner portions 11,12 each having a base 13,16 and a side wall 14,17. The inner and outer portions 12,11 are spaced apart to define an air space 19 therebetween. The inner base 16 of the inner portion 12 has a plurality of apertures 24 therethrough into the air space 19 between the inner and outer bases 16,13 to permit air flow from the air space 19 into the interior space 32 of the trash receptacle to help relieve the vacuum formed when a trash bag 31 is removed from the interior space 32.

In closer detail, the outer portion 11 comprises an outer base 13 and an outer side wall 14 having an upper edge 15. The outer base 13 is generally circular and has a center and a circumferential perimeter. The outer side wall 14 is upwardly extended from the outer base 13 around the perimeter of the outer base 13. Similarly, the inner portion 12 comprises an inner base 16 and an inner side wall 17 having an upper edge 18. The inner base 16 is also generally circular and has a center and a circumferential perimeter. The inner side wall 17 is upwardly extended from the inner base 16 around the perimeter of the inner base 16. The inner side wall 17 defines an interior space 32 for receiving a trash bag 31 therein with the upper edge 18 of the inner side wall 17 defining an upper opening into the interior space 32.

The inner and outer portions 12,11 are spaced apart to define an air space 19 therebetween. In particular, the inner base 16 of the inner portion 12 is spaced apart from the outer base 13 of the outer portion 11 and the inner side wall 17 of the inner portion 12 is spaced apart from the outer side wall 14 of the outer portion 11. Preferably, the inner base 16 of the inner portion 12 is coaxial with the outer base 13 of the outer portion 11. A plurality of support ribs 20 are disposed between the inner and outer bases 16,13. The support ribs 20 provide support to keep the inner base 16 supported and spaced above the outer base 13. Preferably, the support ribs 20 radiate outwards from the centers of the bases towards the perimeters of the bases such that each adjacent pair of support ribs defines a segment space in the air space 19 between the inner and outer bases 16,13.

Figure 2:
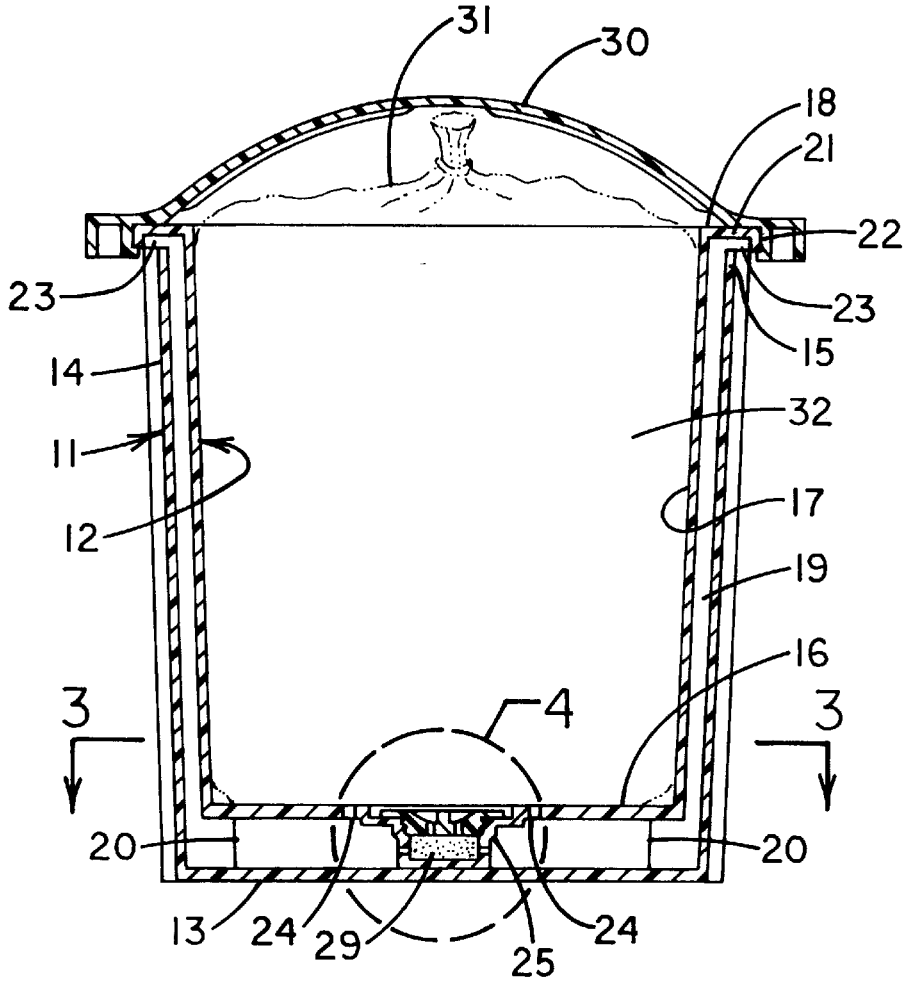
FIG. 2 is a schematic cross sectional view taken from line 2—2 of FIG. 3 of the present invention.
Figure 3:
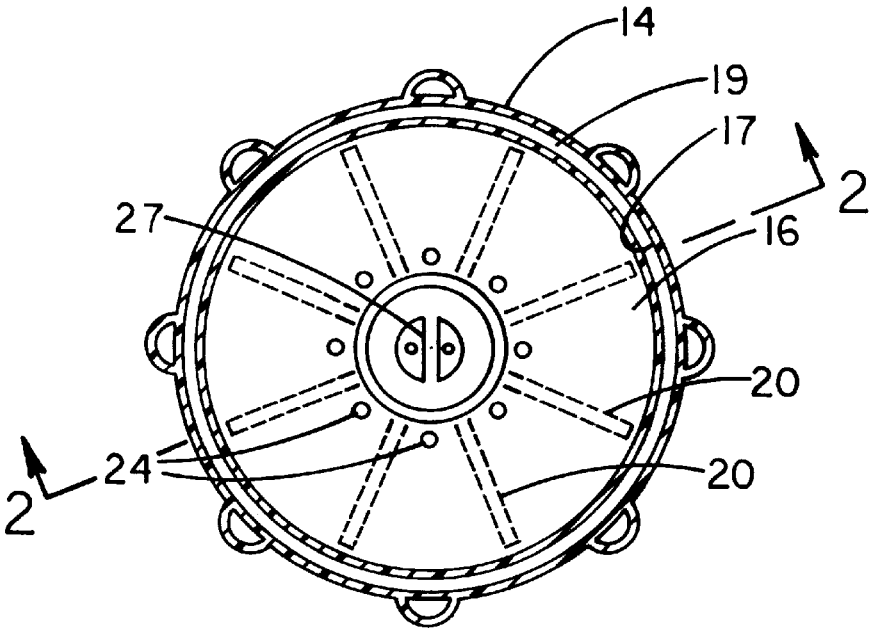
FIG. 3 is a schematic sectional view taken from line 3—3 of FIG. 2 of the present invention.
Figure 4:
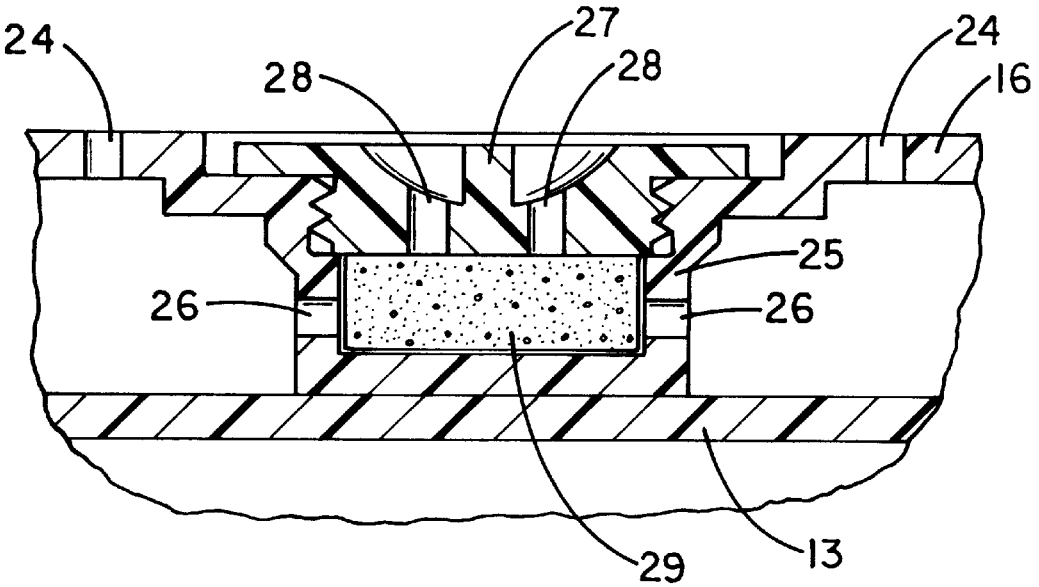
FIG. 4 is a schematic sectional view of the depression of the inner base of the present invention as taken from the circle 4 on FIG. 2.

As illustrated in FIG. 2, the upper edge 18 of the inner side wall 17 of the inner portion 12 preferably has an annular lip 21 outwardly extending therearound. The annular lip 21 defines with the upper edge 15 of the outer portion 11 an air passage 23 into the air space 19 to permit passage 23 of air from the outer environment into the air space 19. Ideally, the annular lip 21 has a downwardly extending rim 22 therearound. The rim helps prevent rain and other precipitation from easily entering the air space 19.

The inner base 16 of the inner portion 12 has a plurality of apertures 24 therethrough into the air space 19 between the inner and outer bases 16,13. The apertures 24 of the inner base 16 are designed for permitting air flow from the air space 19 into the interior space 32 to relieve the vacuum formed between the inner base 16 and bottom of a filled trash bag 31 so that the trash bag 31 can be easily removed from the trash receptacle 10. The apertures 24 of the inner base 16 are preferably positioned towards the center of the inner base 16. Ideally, the apertures 24 of the inner base 16 are arranged on the inner base 16 such that each aperture provides an opening into one of the segment spaces defined between adjacent support ribs 20.

Preferably, the inner base 16 also has a depression 25 therein extending into the air space 19 between the inner and outer bases 16,13 towards the outer base 13. The depression 25 of the inner base 16 is generally cylindrical and has a threaded upper region and a lower region. In the preferred embodiment, the depression 25 of the inner base 16 is positioned at the center of the inner base 16. The lower region of the depression 25 of the inner base 16 has a plurality of holes 26 therethrough into the air space 19 between the inner and outer bases 16,13. The holes 26 of the depression 25 are designed for permitting air to flow from the air space 19 into the depression 25. A scented material 29 preferably having a deodorizing scent is provided in the lower portion of the depression 25. Preferably, a cap 27 removably covers the depression 25 of the inner base 16 with the cap 27 ideally threadably engaging the upper region of the depression 25 to permit easy detachment of the cap 27 from the depression 25. The cap 27 has a plurality of vents 28 therethrough to provide openings into the depression 25 of the inner base 16 when the cap 27 covers the depression 25. The vents 28 of the cap 27 are designed for permitting air flow to pass through from inside the depression 25 into the interior space 32.

A lid 30 may also be provided to cover the upper opening into the interior space 32. As illustrated in FIG. 2, the lid 30 should be designed to not cover the air passage 23 into the air space 19 between the inner and outer portions 12,11.

In use, when a trash bag 31 is removed from the interior space 32, the resulting vacuum between the inner base 16 and the bottom of the trash bag 31 draws air into the air space 19 through the air passage 23. Air then passes through the apertures 24 in the inner base 16 to relieve the formed vacuum. Some of the air passes through the holes 26 in the depression 25 to pick up scent from the scented material 29 which then passes through the vents 28 of the cap 27 to deliver the deodorizing scent to the interior space 32.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A trash receptacle, comprising:

outer and inner portions;

said outer portion comprising an outer base and an outer side wall;

said outer side wall being upwardly extended from said outer base therearound, said outer side wall having an upper edge;

said inner portion comprising an inner base and an inner side wall;

said inner side wall being upwardly extended from said inner base therearound, said inner side wall having an upper edge, said inner side wall defining an interior space for receiving a trash bag therein, said upper edge of said inner side wall defining an upper opening into said interior space;

said inner and outer portions being spaced apart to define an air space therebetween, said inner base of said inner portion being spaced apart from said outer base of said outer portion, said inner base of said inner portion being coaxial with said outer base of said outer portion, said inner side wall of said inner portion being spaced apart from said outer side wall of said outer portion;

a plurality of support ribs being disposed between said inner and outer bases; and said inner base of said inner portion having a plurality of apertures therethrough into said air space between said inner and outer bases; wherein said upper edge of said inner side wall of said inner portion has an annular lip outwardly extending therearound, said annular lip defining a passage thereunder into said air space and extending above and radially outward of said outer side wall.

2. The trash receptacle of claim 1, wherein said annular lip has a downwardly extending rim therearound.

3. The trash receptacle of claim 1, wherein said inner base having a depression therein extending towards said outer base, said depression of said inner base having a plurality of holes therethrough into said air space between said inner and outer bases.

4. The trash receptacle of claim 3, further comprising a scented material being provided in said depression.

5. The trash receptacle of claim 3, further comprising a cap covering said depression of said inner base, said cap having a plurality of vents therethrough to provide openings into said depression of said inner base.

6. The trash receptacle of claim 1, wherein said outer base is generally circular and has a center, wherein said inner base is generally circular and has a center, said inner base of said inner portion being coaxial with said outer base of said outer portion.

7. The trash receptacle of claim 6, wherein said support ribs radiate outwards from said centers of said bases towards said perimeters of said bases such that each adjacent pair of support ribs defines a segment space in said air space between said inner and outer bases.

8. The trash receptacle of claim 7, wherein said apertures of said inner base are arranged on said inner base such that each aperture provides an opening into one of said segment spaces defined by said support ribs.

9. A trash receptacle, comprising:

outer and inner portions;

said outer portion comprising an outer base and an outer side wall;

said outer base being generally circular and having a center and a perimeter;

said outer side wall being upwardly extended from said outer base around said outer perimeter of said outer base, said outer side wall having an upper edge;

said inner portion comprising an inner base and an inner side wall;

said inner base being generally circular and having a center and a perimeter;

said inner side wall being upwardly extended from said inner base around said perimeter of said inner base, said inner side wall having an upper edge, said inner side wall defining an interior space for receiving a trash bag therein, said upper edge of said inner side wall defining an upper opening into said interior space;

said inner and outer portions being spaced apart to define an air space therebetween, said inner base of said inner portion being spaced apart from said outer base of said outer portion, said inner base of said inner portion being coaxial with said outer base of said outer portion, said inner side wall of said inner portion being spaced apart from said outer side wall of said outer portion;

a plurality of support ribs being disposed between said inner and outer bases, said support ribs radiating outwards from said centers of said bases towards said perimeters of said bases such that each adjacent pair of support ribs defines a segment space in said air space between said inner and outer bases;

said upper edge of said inner side wall of said inner portion having an annular lip outwardly extending therearound, said annular lip having a downwardly extending rim therearound, said annular lip defining a passage thereunder into said air space and extending above ans radially outward of said outer side wall;

said inner base of said inner portion having a plurality of apertures therethrough into said air space between said inner and outer bases, said apertures of said inner base being arranged on said inner base such that each aperture provides an opening into one of said segment spaces defined by said support ribs;

said inner base having a depression therein extending towards said outer base, said depression of said inner base being generally cylindrical and having an upper region and a lower region, said depression of said inner base being positioned at said center of said inner base;

said lower region of said depression of said inner base having a plurality of holes therethrough into said air space between said inner and outer bases;

a cap covering said depression of said inner base, said cap being detachably attached to said upper region of said depression, said cap having a plurality of vents therethrough to provide openings into said depression of said inner base; and a scented material being provided in said depression.

* * * * *